US005780200A

United States Patent [19]

Kitaguchi et al.

[11] Patent Number: 5,780,200

[45] Date of Patent: Jul. 14, 1998

[54] PRINTING PLATE MATERIALS AND METHOD OF PRODUCING THE SAME

[75] Inventors: Tohru Kitaguchi, Himeji; Kazuo Notsu, Amagasaki; Kazushi Takahashi, Himeji; Masayoshi Furukawa, Himeji; Shigeki Kambara, Himeji; Osamu Majima; Soichi Kuwahara, both of Tokyo, all of Japan

[73] Assignee: Daicel Chemical Industries, Ltd., Osaka, Japan

[21] Appl. No.: 564,184

[22] PCT Filed: Apr. 19, 1995

[86] PCT No.: PCT/JP95/00764

§ 371 Date: Dec. 18, 1995

§ 102(e) Date: Dec. 18, 1995

[87] PCT Pub. No.: WO95/28288

PCT Pub. Date: Oct. 26, 1995

[30] Foreign Application Priority Data

| | | | |
|---|---|---|---|
| Apr. 19, 1994 | [JP] | Japan | 6-080033 |
| Aug. 1, 1994 | [JP] | Japan | 6-180337 |

[51] Int. Cl.[6] ..... G03C 1/73

[52] U.S. Cl. ..... 430/270.1; 430/300; 430/322; 430/945

[58] Field of Search ..... 430/300, 302, 430/270.1, 284.1, 322, 906, 945; 522/2

[56] References Cited

U.S. PATENT DOCUMENTS

| | | | |
|---|---|---|---|
| 5,156,938 | 10/1992 | Foley et al. | 430/200 |
| 5,262,275 | 11/1993 | Fan | 430/273 |
| 5,330,876 | 7/1994 | Kaszczuk et al. | 430/269 |

FOREIGN PATENT DOCUMENTS

| | | |
|---|---|---|
| 51-6569 | 2/1976 | Japan . |
| 51-35144 | 9/1976 | Japan . |
| 57-37046 | 8/1982 | Japan . |
| 62-52720 | 11/1987 | Japan . |
| 4-506709 | 11/1992 | Japan . |
| 5-8367 | 1/1993 | Japan . |
| 5-246165 | 9/1993 | Japan . |
| 7-32757 | 2/1995 | Japan . |
| WO90/12342 | 10/1990 | WIPO . |

*Primary Examiner*—Janet C. Baxter
*Assistant Examiner*—Rosemary Ashton
*Attorney, Agent, or Firm*—Birch, Stewart, Kolasch & Birch, LLP

[57] ABSTRACT

A printing plate material producing concave-convex pattern on the surface with a low laser energy output and having high scratch resistance is provided by formation of a photosensitive layer comprising a nitrocellulose, carbon black or other photoabsorber and a polyurethane elastomer on a support. The nitrocellulose has a nitrogen content of about 11 to 12.5% and a solution viscosity of about 1 to 1/8 second. The polyurethane elastomer is obtainable by allowing a polyester polyol to react with a polyisocyanate and a chain-extending agent. Relative to 100 parts by weight of the polyurethane elastomer, the amount of nitrocellulose is about 5 to 300 parts by weight and that of the photoabsorber is about 0.5 to 50 parts by weight. The photosensitive layer may have a glass transition temperature of not lower than 25° C. The photosensitive layer may further comprise a plasticizer.

20 Claims, 1 Drawing Sheet

PRINTING PLATE MATERIALS AND METHOD OF PRODUCING THE SAME

TECHNICAL FIELD

This invention relates to a printing plate material which can be sculptured with laser light and to a method for its production.

BACKGROUND TECHNOLOGY

A laser-sculptured printing plate material is known which comprises a mixture of polyethylene and carbon black as molded in the form of a sheet. However, this material requires high-energy laser radiation for creating a concave-convex (three-dimensional) pattern on its surface. For this reason, any printing plate material on which a three-dimensional pattern can be produced with a low-energy laser radiation has not been commercially implemented yet.

Meanwhile, a recording material supplemented with nitrocellulose for enhanced sensitivity is known but this material is deficient in the strength required of any printing plate. By way of example, Japanese Patent Publication No. 35144/1976 (JP-B-51-35144) discloses an image forming technology which comprises coating a support with a photosensitive composition containing nitrocellulose and carbon black and irradiating the coated support with laser light from behind the support which is coated with a photosensitive layer to form an image. Described in this prior art literature is an embodiment in which an ink is transferred to the photosensitive layer for printing. However, this photosensitive layer is invariably of low film strength so that the final material is not practically useful as a printing plate.

Japanese Patent Publication No. 6569/1976 (JP-B-51-6569) discloses an image-forming printing plate material having a photosensitive layer containing nitrocellulose as a self-oxidative binder, carbon black as a particulate pigment capable of absorbing laser energy, and melamine resin as a curing agent (cross-linking agent). This literature describes examples in which an alkyd resin, a methyl methacrylate resin, a butyral resin, an epoxy resin or a novolac resin is further used as a binder resin. However, the photosensitive material described in the above literature is designed for use in the process for producing a lithographic or planographic printing plate which comprises contacting the photosensitive coating layer coated on a support with the polyvinyl alcohol coating layer coated on an aluminum plate and irradiating them with laser light from behind the support to thereby transfer an image corresponding to the irradiated area to the aluminum plate. Therefore, it is not a printing plate belonging to the category in which a printing ink is directly transferred on a photosensitive layer for printing. Moreover, the film strength of the photosensitive layer formed with the photosensitive material is not sufficiently high so that the product can hardly be used, as it is, as a printing plate.

Japanese Patent Application Laid-open No. 506709/1992 (JP-A-4-506709) corresponding to W090/12342 discloses an imaging material as produced using a composition comprising a sensitizer which is capable of absorbing an infrared ray, and a polyurethane as a decomposable binder. The material described in this literature is, however, belonging to the category of a thermal transferring color imaging material where a reverse image is formed by partial thermal decomposition of the decomposable binder and thus transferring the remained binder and a pigment to a receptor sheet. Therefore, it is not a printing plate belonging to the category in which a printing ink is directly transferred on a photosensitive layer for printing.

Accordingly, it is an object of the present invention to provide a printing plate material which can be sculptured even at a low laser energy output, and which can be used in a printing process comprising transferring a printing ink directly on the surface of its layer having a concave-convex (three-dimensional) pattern produced with laser light and has excellent durability and wear resistance (printing pressure resistance) in association with printing, and a method of producing the printing plate material.

It is another object of the present invention to provide a printing plate material which comprises a photosensitive layer having a high sensitivity (thermodegradability) relative to laser light, and insuring excellent scratch resistance (scar resistance) and blocking resistance in spite of containing an elastomer, and a method of producing the same.

A further object of the present invention is to provide a printing plate material provided with a photosensitive layer which insures an improved sensitivity relative to laser light while maintaining its high scratch resistance and blocking resistance, and a method of producing such printing plate material.

It is still another object of the present invention to provide a composition which is useful to form a photosensitive layer having such excellent characteristics as mentioned above.

A yet another object of the present invention is to provide a method of printing in which blocking of a photosensitive layer in storage process can be inhibited and rubber elasticity can effectively be exhibited in printing process.

DISCLOSURE OF THE INVENTION

The inventors of the present invention did intensive research to accomplish the above-mentioned objects and found that by forming a photosensitive layer comprising a nitrocellulose, a photoabsorber, and a polyurethane elastomer as a binder resin on a support, a printing material having a photosensitive layer which is highly thermodegradable on exposure to laser radiation and has a high film strength and scratch resistance can be obtained. The present invention has been developed on the basis of the above finding.

Thus, the printing plate material of the present invention comprises a photosensitive layer comprising a nitrocellulose, a photoabsorber and a polyurethane elastomer, and a support on which the photosensitive layer is formed. As the nitrocellulose, a variety of nitrocelluloses which can be thermally decomposed with laser light, for example a nitrocellulose with a nitrogen content of about 10 to 14%, a degree of polymerization in the range of about 10 to 1,500, and a solution viscosity, according to Japanese Industrial Standards (JIS) K6703, of about 20 to 1/10 second. The photoabsorber includes carbon black or others, and the polyurethane elastomer includes, for example, a polyurethane elastomer having an elongation percentage of not less than 400% and a glass transition temperature of not higher than −10° C. The photosensitive layer of the printing plate material may contain a plasticizer.

The above printing plate material may be manufactured by coating a support such as a film with a coating composition comprising a nitrocellulose, a photoabsorber, a polyurethane elastomer, and if necessary, a plasticizer to provide a photosensitive layer which can be sculptured with an application of laser light.

As used throughout this specification, the term "film" includes a sheet unless otherwise specified.

DETAILED DESCRIPTION OF THE INVENTION

Figure 1:
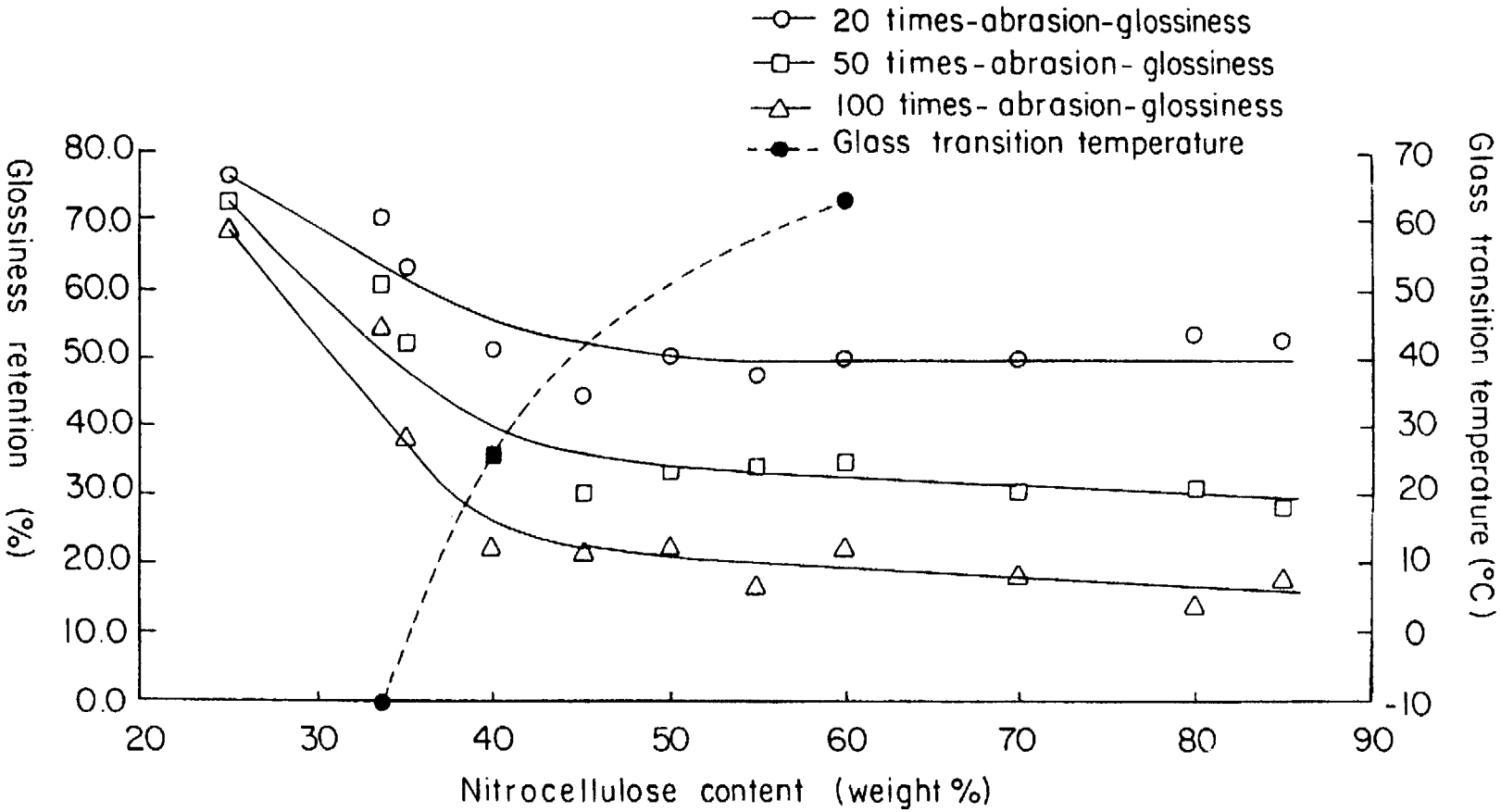
FIG. 1 is a graph illustrating a relationship between a nitrocellulose content in a photosensitive layer, and a glossiness retention in association with abrasion or wearing and a glass transition temperature of the photosensitive layer.

The printing plate material of the present invention comprises a photosensitive layer comprising a nitrocellulose, a photoabsorber and a polyurethane elastomer, and a support. The species of the nitrocellulose to be incorporated in the photosensitive layer is not particularly restricted only if it is thermally degradable, and may be whichever grade of RS (regular soluble) type or grade, SS (spirit soluble) type and AS (alcohol soluble) type. The nitrogen content of the nitrocellulose is generally about 10 to 14%, preferably about 11 to 12.5%, and more preferably about 11.5 to 12.2%. The degree of polymerization of the nitrocellulose can also liberally be selected within a broad range of, for example, about 10 to 1,500. The preferred degree of polymerization of the nitrocellulose may, for instance, be about 10 to 900 and particularly about 15 to 150. The preferred nitrocellulose includes a nitrocellulose with a solution viscosity of about 20 to 1/10 second, preferably about 10 to 1/8 second, as determined in accordance with Japanese Industrial Standards (JIS) K6703 "Industrial Nitrocellulose" (the viscosity denomination of Hercules Powder Company). The practically used nitrocellulose has a solution viscosity of about 5 to 1/8 second, particularly about 1 to 1/8 second. If necessary, two or more species of nitrocellulose can be used in combination.

The amount of the nitrocellulose may be selected from a range not adversely affecting the sensitivity of the photosensitive layer and may be about 5 to 300 parts by weight, preferably about 20 to 250 parts by weight, and more preferably about 50 to 200 parts by weight relative to 100 parts by weight of the polyurethane elastomer. The nitrocellulose may practically be used in a proportion of about 40 to 200 parts by weight relative to 100 parts by weight of the polyurethane elastomer.

The photoabsorber (photoabsorbing component) includes a variety of absorbers which absorb laser energy with high efficiency, such as a black dye and other dyes and carbon material. The preferred species of the carbon material includes carbon black, and insofar as a high dispersion stability can be imparted to the composition, any of the species defined in American Society for Testing Materials (ASTM) and/or indicated for whatever uses (e.g. colors, rubber, dry batteries, etc.) can be employed. For example, the carbon black includes furnace black, thermal black, channel black, lamp black and acetylene black and the like.

A black coloring agent such as carbon black can be used in the form of color chips or a color paste, which can be prepared by dispersing it beforehand in a nitrocellulose, and when necessary using a dispersing agent, in which case the dispersion thereof is facilitated. Such chips and paste are readily available from commercial sources.

The amount of the photoabsorber may be selected from the range not sacrificing the sensitivity of the photosensitive layer and is, for example, about 0.5 to 50 parts by weight, preferably about 2.5 to 40 parts by weight and more preferably about 10 to 30 parts by weight relative to 100 parts by weight of the polyurethane elastomer. The photoabsorber may practically be employed in a proportion of about 5 to 50 parts by weight relative to 100 parts by weight of the polyurethane elastomer.

A feature of the present invention, in one aspect, resides in a combination use of the nitrocellulose and the photoabsorber with a polyurethane elastomer. The above photosensitive layer of the printing plate material has such advantages that a pit pattern (three-dimensional pattern) can be formed on the photosensitive layer even at a low laser energy output and the film strength and scratch resistance of the photosensitive layer can be enhanced. Further, a high scratch resistance, and thus a high durability and printing press resistance can be expected even when a printing ink is directly transferred to the three-dimensionally patterned photosensitive layer.

The species of the polyurethane elastomer may not be particularly restricted insofar as not interfering with the sensitivity to laser light, printing press resistance or other properties of the photosensitive layer. As such polyurethane elastomer, there may be used a variety of polyurethane elastomers which are obtainable by using a polyol such as a polyester polyol, a polyether polyol and an acrylpolyol, a polyisocyanate, and as necessary, a chain-extending agent or chain-extending component such as a polyhydric alcohol and/or a polyamine. The polyol may be used singly or in combination, and it may practically comprise at least a polyester polyol. As the polyester polyol, a linear polyester polyol can preferably be for its high elasticity, but a polyester polyol having a few branches may also be employed because the viscosity increases with an increasing molecular weight.

The components of the polyester polyol include a polycarboxylic acid component and a polyhydric alcohol component. The polycarboxylic acid component includes, for instance, aromatic carboxylic acids such as phthalic acid, isophthalic acid, terephthalic acid, etc. or the corresponding anhydrides; saturated or unsaturated aliphatic carboxylic acids such as glutaric acid, adipic acid, azelaic acid, sebacic acid, maleic acid, fumaric acid, dimeric linolenic acid and the like, or the corresponding anhydrides. These polycarboxylic acid components may be used independently or in combination. As such aliphatic carboxylic acid, saturated aliphatic dicarboxylic acids such as adipic acid, azelaic acid, sebacic acid and so on may practically be employed.

As examples of the polyhydric alcohol component, there may be mentioned aliphatic dihydric alcohols such as ethylene glycol, propylene glycol, trimethylene glycol, 1,3-butanediol, 2,3-butanediol, 1,4-butanediol, 1,5-pentanediol, 1,6-hexanediol, neopentyl glycol, etc.; polyoxyalkylene glycols such as diethylene glycol, triethylene glycol, tetraethylene glycol, dipropylene glycol, tripropylene glycol, tetrapropylene glycol and so forth; aliphatic polyhydric alcohols such as glycerin, trimethylolpropane, trimethylolethane, hexanetriol, pentaerythritol, etc.; and bisphenol A-alkylene oxide adducts such as 2,2-bis(4-dihydroxypropylphenyl) propane, typically speaking. These polyhydric alcohol components can also be employed singly or in combination. As the polyhydric alcohol component, at least an aliphatic dihydric alcohol and/or a polyoxyalkylene glycol may generally be used.

The molecular weight of the polyester polyol may for example be about 500 to 5,000, preferably about 700 to 3,000, and more preferably about 1,000 to 2,000.

Examples of the polyisocyanate include aromatic diisocyanates such as 2,4-tolylene diisocyanate, 2,6-tolylene diisocyanate, phenylene diisocyanate, xylylene diisocyanate, diphenylmethane diisocyanate, 1,5-naphthalene diisocyanate and the like; aliphatic diisocyanates such as 1,4-tetramethylene diisocyanate, 1,6-hexamethylene diisocyanate, 1,10-decamethylene diisocyanate and so forth; and alicyclic diisocyanates such as isophorone diisocyanate and so on. Such polyisocyanates can be employed singly or in combination.

As the chain-extending agent (chain-extender), use may be made of polyhydric alcohols as exemplified above (e.g. diols (dihydric alcohols) such as ethylene glycol, propylene glycol, trimethylene glycol, 1,3-butanediol, 2,3-butanediol, 1,4-butanediol, 1,5-pentanediol, 1,6-hexanediol and neopentyl glycol, polyols (polyhydric alcohols) such as glycerin, trimethylolpropane, trimethylolethane, pentaerythritol and so on). By the same token, polyamines can also be used as the chain-extending agent. Examples of such polyamide include (poly)alkylenepolyamines such as ethylenediamine, diethylenetriamine, triethylenetetramine, hexamethylenediamine, propylenediamine, etc.; and alkanolamines such as monoethanolamine, diethanolamine, triethanolamine and so forth. Polyhydric alcohols can preferably be used as the chain-extending agent.

The polyurethane elastomer may practically be prepared by a reaction of a polyester polyol, polyisocyanate and a polyhydric alcohol, or a reaction of a prepolymer having an isocyanate group with a chain-extending agent (e.g. polyhydric alcohols, etc.). Such prepolymer is produced by allowing a polyol such as the above-mentioned polyester polyol to react with a polyisocyanate.

As the polyurethane elastomer, whichever of elastomers may be used as far as not adversely affecting the sensitivity to laser light, strength or other properties of the photosensitive layer. Preferred example of the polyurethane elastomer includes a polyurethane elastomer having an elongation percentage (extension percentage) of not less than 400% (e.g. about 400 to 1,000%), preferably not less than 500% (e.g. about 500 to 900%). The glass transition temperature (Tg) of the polyurethane elastomer may for example be not higher than −10° C. (e.g. about −10° C. through −50° C.), preferably not higher than −15° C. (e.g. about −15° C. through −45° C.) and more preferably not higher than −20° C. (e.g. about −20° C. through −40° C.).

The glass transition temperature of the photosensitive layer may for example be about −25° C. to 40° C., preferably about −15° C. to 35° C., and more preferably about −10° C. to 30° C. While, depending on the proportion of the nitrocellulose relative to the polyurethane elastomer, blocking of the photosensitive layer may occasionally occur when sheet-like printing plate materials are piled up. Accordingly, in order to improve the durability and scratch resistance of the material with inhibiting or suppressing such blocking of the photosensitive layer, the glass transition temperature of the photosensitive layer may preferably be not lower than 25° C. (e.g. about 25° C. to 40° C.), and preferably about 25° C. to 35° C.

In more detail, the glass transition temperature of a polyurethane elastomer is, usually, lower than room temperature, and is about −15° C. through −50° C., typically speaking. When a photosensitive layer is formed using such polyurethane elastomer and a nitrocellulose, the glass transition temperature of the photosensitive layer increases or elevates with an increasing proportion of the nitrocellulose, because the nitrocellulose has a high glass transition temperature. By way of illustration as shown in FIG. 1, the glass transition temperature of a film elevates with an increasing amount of the nitrocellulose, in a photosensitive layer formed with a composition comprising a polyurethane elastomer with a glass transition temperature of −23° C., a nitrocellulose with a glass transition temperature of about 60° C. and 10% by weight of carbon black. In fact, for the film which contains 33.7% by weight of the nitrocellulose, the glass transition temperature of the film is about −10° C., and hence it exhibits rubber elasticity at room temperature. While, the degree of wear or abrasion caused by an abrasion wheel decreases with an increasing nitrocellulose content. That is, when the scratch resistance (flaw resistance) is evaluated by a glossiness retention as determined by altering the abrasion times (repetition times of wearing process) with the glossiness of a non-abraded sample being 100%, as illustrated in FIG. 1, the flaw resistance decreases with an increasing nitrocellulose content in the photosensitive layer, and is in an approximately fixed level when the nitrocellulose content is about 40% by weight or more. This is provably because the glass transition temperature becomes about 30° C. or higher in a case with a nitrocellulose content of not less than 40% by weight so that the rubber elasticity will not exhibit at room temperature (around 25° C.).

As described above, when a photosensitive layer has rubber elasticity at room temperature, and a printing plate material provided with such photosensitive layer is piled up with other sheet or film with a load weighed thereon, there possibly occurs blocking phenomenon where the photosensitive layer and the sheet or film are adhered or stuck to each other. Accordingly, by controlling the glass transition temperature of a photosensitive layer to be not lower than 25° C. (e.g. 25° C. to 40° C.), the photosensitive layer is almost in a glassy state at room temperature so that such risk of the blocking of material can be unburdened. A printing plate material having a photosensitive layer with such glass transition temperature has the following advantages. Namely, when the printing plate material is stored at room temperature or lower, blocking of the photosensitive layer with a sheet or others can be inhibited. On the other hand, when the material is used as a plate material in a printing process where a pit pattern is formed on exposure to laser light and a flaw resistance of the material is required, the photosensitive layer can exhibit the rubber elasticity by printing at a temperature higher than the glass transition temperature of the photosensitive layer so that scratch formation of the photosensitive layer during the printing process can be prevented.

The glass transition temperature of the photosensitive layer can be adjusted or controlled according to the relative proportion of the nitrocellulose to the polyurethane elastomer, as described above. According to differential scanning thermal analysis, a photosensitive layer comprising a nitrocellulose and a polyurethane elastomer generally shows a single peak which is not found in the nitrocellulose and polyurethane elastomer as such, while such peak depends on the species of the constituting components and photosensitive layer. Therefore, it is supposed that the nitrocellulose and polyurethane elastomer are compatible with each other in the photosensitive layer.

In such photosensitive layer, a high nitrocellulose content for an improved sensitivity to laser light and thereby a high glass transition temperature may occasionally result in decreased scratch resistance and durability. In such a case, addition of a plasticizer is useful. That is, even when the nitrocellulose content is increased, addition of a plasticizer results in an inhibition of increase of the glass transition temperature of the photosensitive layer and hence insures high durability and scratch resistance (wear resistance). Further, the sensitivity (thermal degradability) to laser light can also be improved with an increasing amount of the nitrocellulose. The plasticizer may effectively be incorporated into a composition which constitutes a photosensitive layer with a glass transition temperature of about 0° C. through 40° C., preferably about 10° C. through 30° C.

As the species of plasticizer, there is no particular restriction and whichever plasticizer can be employed as far as thereby a photosensitive layer comprising a nitrocellulose, a photoabsorber and a polyurethane elastomer is plasticizable. The plasticizer includes, for instance, camphor or its derivative, phthalic acid esters (e.g. dimethyl phthalate, diethyl phthalate, dibutyl phthalate, diisobutyl phthalate, dihexyl phthalate, dioctyl phthalate di(2-ethylhexyl) phthalate, etc.), phosphoric esters (e.g. triphenyl phosphate, tricresyl phosphate, etc.), adipic acid esters (e.g. di(2-ethylhexyl) adipate, etc.), sebacic acid esters (e.g. dibutyl sebacate, etc.) and so on. These plasticizers may be used independently or in combination.

The amount of the plasticizer can be selected according to the species of the nitrocellulose and polyurethane elastomer, the glass transition temperature of the photosensitive layer and/or other factors, for example within the range of about 0.1 to 30 parts by weight, preferably about 1 to 20 parts by weight, and more preferably about 2 to 15 parts by weight relative to 100 parts by weight of the composition for the photosensitive layer (i.e. the total amount of the nitrocellulose, photoabsorber and polyurethane elastomer).

If required, the photosensitive layer may contain a variety of additives such as antioxidants, ultraviolet absorbers or other aging inhibitors, crosslinking agents, crosslinking accelerators (cure accelerators), flame retardants, fillers, coloring agents, leveling agents and so on.

The shape of the support is not restricted only if it is printable form and may for example be drum-like, film-like, sheet-like or other form. Although the material of the support is not particularly limited, a poly(ethylene terephthalate) film or other polymer film may practically be employed when a support of film or sheet form is chosen. Where necessary, the support may be surface-treated, or an under coating layer (adhesive layer) may be interposed between the photosensitive layer and the support for an improved adhesivility (adhesive property) to the photosensitive layer.

The thickness of the photosensitive layer formed on the support can be selected within the range not sacrificing the durability or other properties of the photosensitive layer and is, for instance, about 1 to 100 μm, preferably about 10 to 50 μm, and practically about 15 to 30 μm.

The above-mentioned photosensitive layer may be formed by coating such a support with a coating composition comprising a nitrocellulose, a photoabsorber and a polyurethane elastomer. The coating composition may be prepared by mix-dispersing the nitrocellulose, photoabsorber and polyurethane elastomer in an organic solvent using a conventional mixer or dispersing machine. The organic solvent includes, for example, alcohols such as ethanol, isopropanol and so on; aliphatic hydrocarbons such as hexane, octane and the like; alicyclic hydrocarbons such as cyclohexane, etc.; aromatic hydrocarbons such as benzene, toluene, xylene and so forth; halogenated hydrocarbons such as dichloromethane, dichloroethane, etc.; ketones such as acetone, methyl ethyl ketone and the like; esters such as ethyl acetate, butyl acetate and so on; ethers such as diethyl ether, tetrahydrofuran, etc.; and various mixtures of these solvents.

As the photosensitive layer formed in the above manner is irradiated with laser light image-wise, i.e. in accordance with a predetermined pattern, there is obtained a printing plate having a three-dimensional pattern (pit) in the photosensitive layer. Where the support is transparent, the laser beam may be projected from the support side to the photosensitive side, or irradiation may be performed from the photosensitive side. As the source of laser radiation, there may used various types of lasers such as Ar lasers, He—Ne lasers, He—Cd lasers, $CO_2$ lasers, YGA lasers and semiconductor lasers, typically speaking.

INDUSTRIAL APPLICABILITY

The printing plate material of the present invention can be used as the printing plate for gravure printing, flexo printing and other printing applications, as formed with a pit pattern (three-dimensional pattern) by irradiation of laser light.

EXAMPLES

The following examples are intended to describe this invention in further detail but should by no means be interpreted as defining the scope of the invention.

Example 1

A paint shaker preloaded with ceramic beads (3 mm in diameter) was charged with 7.7 parts by weight of a nitrocellulose RS ¼ (Daicel Chemical Industries, Ltd., isopropyl alcohol-wetted, nonvolatile 70% by weight), 21.1 parts by weight of a carbon black paste (Toyo Ink Manufacturing, Co., Ltd., Color Paste ANP-C-903 Black, carbon black content of 12% by weight, nitrocellulose H ½ content of 18% by weight), 40.1 parts by weight of a polyurethane elastomer (Nippon Polyurethane Industries, Ltd., N2304, nonvolatile 35% by weight, elongation percentage of 750%, glass transition temperature of −23° C.), and 32.2 parts by weight of methyl ethyl ketone, and the charged was mixed and dispersed by shaking for 30 minutes to give a coating composition. Using an applicator, the resulting coating composition was coated in a dry thickness of 25 μm on a poly(ethylene terephthalate) film (188 μm in thickness) and dried at 110° C. for 2 minutes to provide a printing plate material.

Examples 2 to 9

Printing plate materials each having a photosensitive layer with a composition (formulation) as set forth in Table 1 were obtained in the same manner as Example 1 except that the proportions of the components in Example 1 were changed.

Examples 10 and 11

By repeating the procedure of Example 1, printing plate materials each having a photosensitive layer with a composition shown in Table 1 were obtained except for using a polyurethane elastomer (Nippon Polyurethane Industries, Ltd., N3022, nonvolatile 35% by weight, elongation percentage of 800%, glass transition temperature of −38° C.) in lieu of the polyurethane elastomer used in Example 1, and employing the nitrocellulose, carbon black paste and methyl ethyl ketone used in Example 1.

Examples 12 and 13

The procedure of Example 1 was repeated except that a polyurethane elastomer (Nippon Polyurethane Industries, Ltd., N3107, nonvolatile 40% by weight, elongation percentage of 850%, glass transition temperature of −33° C.) was employed in stead of the polyurethane elastomer used in Example 1, and the nitrocellulose, carbon black paste and methyl ethyl ketone of Example 1 were used to provide printing plate materials each having a photosensitive layer with a composition set forth in Table 1.

Examples 14 and 15

By using a polyurethane elastomer (Nippon Polyurethane Industries, Ltd., N3118, nonvolatile 40% by weight, elongation percentage of 800%, glass transition temperature of −38° C.) in lieu of the polyurethane elastomer used in Example 1 and employing the nitrocellulose, carbon black paste and methyl ethyl ketone, printing plate materials each having a photosensitive layer with a composition shown in Table 1 were obtained.

Example 16

A printing plate material having a photosensitive layer with a composition set forth in Table 1 was manufactured by using a polyurethane elastomer (Nippon Polyurethane Industries, Ltd., N3110, nonvolatile 25% by weight, elongation percentage of 700%, glass transition temperature of −15° C.) in stead of the polyurethane elastomer used in Example 1, and employing the nitrocellulose, carbon black paste and methyl ethyl ketone used in Example 1.

Comparative Example 1

A printing plate material was manufactured in the same manner as Example 1 except for employing 7.7 parts by weight of a nitrocellulose RS ¼ (Daicel Chemical Industries, Ltd., isopropanol-wetted, nonvolatile 70% by weight), 24.6 parts by weight of a carbon black paste (Toyo Ink manufacturing, Co., Ltd., Color Paste ANP-C-903 Black), 43.3 parts by weight of a polyester resin (Toyobo Co., Ltd., Vylon 20SS, nonvolatile 30% by weight), 5.4 parts by weight of a crosslinking agent (Dainippon Ink and Chemicals, Inc., melamine resin, Super-Beckamine L-105-60, nonvolatile 60% by weight), 0.4 part by weight of an acid catalyst (BYK Co., BYK CATALYST 450, nonvolatile approximately 40% by weight) and 18.7 parts by weight of methyl ethyl ketone.

Comparative Example 2

The procedure of Example 1 was repeated except for using 14.4 parts by weight of a nitrocellulose RS ¼ (Daicel Chemical Industries, Ltd., isopropanol-wetted, nonvolatile 70% by weight), 3.7 parts by weight of carbon black (Mitsubishi Chemical Industries Ltd., MA100), 78.1 parts by weight of a vinyl chloride-vinyl acetate copolymer (Denki Kagaku Kogyo Co., Ltd., Denka Vinyl 1000C), 10.9 parts by weight of methyl ethyl ketone, 4.3 parts by weight of isopropanol and 8.6 parts by weight of toluene to provide a printing plate material.

The printing plate materials obtained in each example and Comparative Example 1 were abraded with the use of Taber's abrasion apparatus (Yasuda Seiki Co., Ltd., Taber's abrasion tester, abrading wheel CS-10, load 500 g). The scratch resistance of each abraded printing plate material was evaluated by determining, with the use of a glossimeter (Moritex Co., Ltd., PRANGE Glossimeter RB3, incident angle and reflection angle =60°), the decrease of glossiness of the material associated with the repetition of abrading. The glossiness in the predetermined times of abrasion (20 times, 50 times and 100 times) was determined with the glossiness of the non-abraded sample being 100%. The results are set forth in Table 1.

TABLE 1

| | Composition of photosensitive layer (weight %) | | | Glossiness (%) | |
|---|---|---|---|---|---|
| | Nitrocellulose | Carbon black | Resin | 50 times | 100 times |
| Example 1 | 35.5 | 10 | 54.5 | 61.0 | 54.8 |
| Example 2 | 33.75 | 10 | 56.25 | 61.0 | 54.8 |
| Example 3 | 35 | 11.5 | 53.5 | 53.7 | 37.6 |
| Example 4 | 25 | 10 | 65 | 72.7 | 68.8 |
| Example 5 | 35 | 10 | 55 | 52.6 | 38.2 |
| Example 6 | 37 | 5 | 58 | 63.2 | 54.3 |
| Example 7 | 35 | 10 | 55 | 63.0 | 52.1 |
| Example 8 | 33 | 15 | 52 | 59.2 | 49.4 |
| Example 9 | 31 | 20 | 49 | 60.5 | 52.2 |
| Example 10 | 35.75 | 10 | 54.25 | 83.2 | 77.9 |
| Example 11 | 41 | 10 | 49 | 55.6 | 41.1 |
| Example 12 | 35.75 | 10 | 54.25 | 76.1 | 68.3 |
| Example 13 | 41 | 10 | 49 | 66.4 | 51.1 |
| Example 14 | 35.75 | 10 | 54.25 | 78.5 | 69.3 |
| Example 15 | 45 | 10 | 45 | 66.8 | 56.5 |
| Example 16 | 25 | 10 | 65 | 55.1 | 40.1 |
| Comp. Ex. 1 | 38.1 | 11.5 | 50.4 | 30.2 | 20.2 |

Besides, the plate material according to Example 1 was fixed on a rotating drum, rotated at a rate of 3 rps and irradiated with a pulse ray of a semiconductor laser (He—Cd laser, wave length 441 nm, 5 mW) for 50 msec to produce pits on the photosensitive layer of the plate material. As a result, pits having excellent geometry (configuration) with a sharp edge and a rather smooth (scarce concave-convex) bottom were provided. Further, the pits had satisfactory depth of 5.86 μm, as determined with the use of a scanning laser microscope (LASERTEC Co., 1LM21), which demonstrated high sensitivity of the photosensitive layer to laser light. Therefore, even at a high speed, a three-dimensional pattern (pit) could be formed by laser irradiation on such material. On the contrary, when the depth of pits in the plate material according to Comparative Example 2 was evaluated by irradiating laser light in the same manner as above, the depth of pits was shallow and hence it could not precisely be determined with a laser microscope. Moreover, the pits had a geometry or configuration with a obscure edge and greatly corrugated bottom.

Example 17

According to the manner of Example 1, a printing plate material was manufactured except for employing 9.3 parts by weight of a nitrocellulose RS ¼ (Daicel Chemical Industries, Ltd., isopropanol-wetted, nonvolatile 70% by weight), 20.8 parts by weight of a carbon black paste (Toyo Ink Manufacturing, Co., Ltd., Color Paste ANP-C-903 Black, carbon black content of 12% by weight, nitrocellulose H ½ content of 18% by weight), 5 35.0 parts by weight of a polyurethane elastomer (Nippon Polyurethane Industries, Ltd., N2304, nonvolatile 35% by weight, elongation percentage of 750%, glass transition temperature of −23° C.) and 34.9 parts by weight of methyl ethyl ketone.

The glass transition temperature of the photosensitive layer was 26° C. as determined using a differential scanning calorimeter (DSC).

The resultant glossiness of the photosensitive layer of the material in association with 100 times-abrasion at temperatures of 23° C. and 50° C. was respectively 26.2% (23° C.) and 50.1% (50° C.) as determined in the same manner as above. Thus, the scratch resistance was improved at a temperature higher than the glass transition temperature of the photosensitive layer.

Further, the photosensitive layer of the plate material was irradiated by pulse ray of a semiconductor laser light in the above-mentioned manner, and pits having a satisfactory configuration with a sharp edge and a rather smooth bottom were obtained. The photosensitive layer showed high sensitivity with a satisfactory pit depth of 5.86 μm as determined with a scanning laser microscope (LASERTEC Co., 1LM21).

Furthermore, the obtained plate material was subjected to blocking test in the following manner. That is, the plate material was cut into 2 pieces with a square configuration (5 cm×5 cm), the 2 pieces were piled up with the photosensitive layers facing to each other, and the pile of the plate materials was further put between glass plates having the same areas with that of the cut materials, and a load of 1 kg was weighed on thus obtained test piece at 40° C. As a result, blocking was not observed even after 5 hours from the initial of weighing.

Example 18

A printing plate material was obtained in the similar manner to Example 1 except that 5.1 parts by weight of a nitrocellulose RS ¼ (Daicel Chemical Industries, Ltd., isopropanol-wetted, nonvolatile 70% by weight), 22.9 parts by weight of a carbon black paste (Toyo Ink Manufacturing, Co., Ltd., Color Paste ANP-C-903 Black LV, carbon black content of 10% by weight, nitrocellulose H ½ content of 15% by weight), 26.4 parts by weight of a polyurethane elastomer (Nippon Polyurethane Industries, Ltd., N2304, nonvolatile 35% by weight, elongation percentage of 750%, glass transition temperature of −23° C.), 1.4 part by weight of camphor and 44.3 parts by weight of methyl ethyl ketone were used and the mix-dispersing was conducted for 1 hour using the paint shaker.

Examples 19 and 20

The procedure of Example 18 was repeated except for changing the proportions of the components used in Example 18 to give printing plate materials each having a photosensitive layer with a composition shown in Table 2.

The glossiness associated with 50 times- and 100 times-abrasion of the plate materials according to each example was determined. The results are set forth in Table 2.

TABLE 2

| | Composition of photosensitive layer (weight %) | | | | Glossiness (%) | |
|---|---|---|---|---|---|---|
| | Nitrocellulose | Carbon black | Resin | Plasticizer | 50 times | 100 times |
| Example 18 | 35.1 | 11.5 | 46.4 | 7.02 | 54.8 | 40.5 |
| Example 19 | 35 | 11.5 | 47.06 | 6.44 | 54.8 | 40.5 |
| Example 20 | 40.9 | 11.5 | 40 | 7.61 | 51.5 | 38.4 |

Further, the photosensitive layer of each printing plate material was irradiated, in the same manner as above, by a pulse radiation of a semiconductor laser light to form pits, and resultantly it showed high sensitivity to laser light with a pit depth of 6.25 μm. The pits had a good configuration with a sharp edge and rather smooth bottom.

We claim:

1. A printing plate material which comprises a photosensitive layer containing a nitrocellulose, a photoabsorber and a polyurethane elastomer having an elongation percentage of not less than 400% and a glass transition temperature of not higher than −10° C., and a support on which said photosensitive layer is formed.

2. The printing plate material as claimed in claim 1, wherein said nitrocellulose has a nitrogen content of 10 to 14%.

3. The printing plate material as claimed in claim 1, wherein said nitrocellulose has a degree of polymerization in the range of 10 to 1,500.

4. The printing plate material as claimed in claim 1, wherein said nitrocellulose has a solution viscosity, according to Japanese Industrial Standards (JIS) K6703, of 20 to 1/10 second.

5. The printing plate material as claimed in claim 1, wherein said nitrocellulose has a nitrogen content of 11 to 12.5%, a degree of polymerization in the range of 10 to 900 and a solution viscosity, according to JIS K6703, of 10 to 1/8 second.

6. The printing plate material as claimed in claim 1, wherein said photoabsorber is carbon black.

7. The printing plate material as claimed in claim 1, wherein said polyurethane elastomer is an elastomer obtainable by allowing a polyester polyol to react with a polyisocyanate and a chain-extending agent, and has an elongation percentage of not less than 400% and a glass transition temperature of not higher than −10° C.

8. The printing plate material as claimed in claim 1, wherein said polyurethane elastomer has an elongation percentage of 400 to 1,000%, and a glass transition temperature in the range of −10° C. through −50° C.

9. The printing plate material as claimed in claim 1, wherein said photosensitive layer has a glass transition temperature in the range of −25° C. to 40° C.

10. The printing plate material as claimed in claim 1, wherein said photosensitive layer has a glass transition temperature of not lower than 25° C.

11. The printing plate material as claimed in claim 1, wherein said photosensitive layer comprises 5 to 300 parts by weight of the nitrocellulose and 0.5 to 50 parts by weight of the photoabsorber relative to 100 parts by weight of said polyurethane elastomer.

12. The printing plate material as claimed in claim 1, wherein said photosensitive layer comprises 20 to 250 parts by weight of a nitrocellulose having a nitrogen content of 11.5 to 12.2% and a solution viscosity, according to JIS K6703, of 1 to 1/8 second, and 2.5 to 40 parts by weight of carbon black relative to 100 parts by weight of the polyurethane elastomer.

13. The printing plate material as claimed in claim 1, wherein said photosensitive layer comprises 50 to 200 parts by weight of the nitrocellulose and 5 to 50 parts by weight of the photoabsorber relative to 100 parts by weight of a polyurethane elastomer having an elongation percentage of 500 to 900% and a glass transition temperature in the range of −15° C. through −45° C.

14. The printing plate material as claimed in claim 1, wherein said photosensitive layer further contains a plasticizer.

15. The printing plate material as claimed in claim 14, wherein said plasticizer is at least one member selected from the group consisting of camphor, phthalic acid esters, phosphoric esters, adipic acid esters and sebacic acid esters.

16. The printing plate material as claimed in claim 14, wherein the proportion of said plasticizer is 0.1 to 30 parts by weight relative to 100 parts by weight of the total amount of said constitutive nitrocellulose, photoabsorber and polyurethane elastomer in said photosensitive layer.

17. The printing plate material as claimed in claim 14, which has a photosensitive layer comprising a nitrocellulose, a photoabsorber and a polyurethane elastomer and having a glass transition temperature in the range of 0° C. to 40° C., where the plasticizer is incorporated into said photosensitive layer in a proportion of 1 to 20 parts by weight relative to 100 parts by weight of the total amount of said constituting nitrocellulose, photoabsorber and polyurethane elastomer in said photosensitive layer.

18. A printing photosensitive composition which comprises a nitrocellulose, a photoabsorber and a polyurethane elastomer having an elongation percentage of not less than 400% and a glass transition temperature of not higher than −10° C., and on which a pit may be formed by laser irradiation.

19. A method of producing a printing plate material which comprises coating a coating composition comprising a nitrocellulose, a photoabsorber and a polyurethane elastomer having an elongation percentage of not less than 400% and a glass transition temperature of not higher than −10° C. on a support to provide a photosensitive layer which can be sculptured with laser light.

20. The method of producing a printing plate material according to claim 19, wherein said coating composition further comprises a plasticizer and is coated on said support.

* * * * *